United States Patent [19]

Yamato

[11] Patent Number: 4,576,092

[45] Date of Patent: Mar. 18, 1986

[54] UNIFORM-PRESSURE PRESS APPARATUS

[75] Inventor: Yoshiharu Yamato, Numazu, Japan

[73] Assignee: Kohtaki & Co., Ltd., Tokyo, Japan

[21] Appl. No.: 586,516

[22] Filed: Mar. 5, 1984

[30] Foreign Application Priority Data

Aug. 22, 1983 [JP] Japan ..... 58-151697

[51] Int. Cl.[4] ..... B30B 15/32

[52] U.S. Cl. ..... 100/218; 100/93 P; 100/295

[58] Field of Search ..... 100/214, 218, 269 R, 100/295, 93 P, 918, 211; 72/63, 296, 382

[56] References Cited

U.S. PATENT DOCUMENTS

| | | | |
|---|---|---|---|
| 2,627,628 | 2/1953 | Pare | 100/93 P X |
| 4,080,243 | 3/1978 | Pohl . | |
| 4,156,589 | 5/1979 | Schmitt | 100/211 X |

FOREIGN PATENT DOCUMENTS

| | | | |
|---|---|---|---|
| 2204238 | 8/1973 | Fed. Rep. of Germany | 100/93 P |
| 51-20467 | 6/1976 | Japan . | |
| 53-147782 | 12/1978 | Japan . | |
| 55-26959 | 7/1980 | Japan . | |
| 56-30480 | 7/1981 | Japan . | |
| 57-103813 | 6/1982 | Japan . | |
| 708070 | 4/1954 | United Kingdom | 100/29 S |

*Primary Examiner*—Billy J. Wilhite

*Attorney, Agent, or Firm*—Flynn, Thiel, Boutell & Tanis

[57] ABSTRACT

A uniform-pressure press apparatus has a single or a plurality of liquid-in-pressure equalizing chambers independently provided in at least one of a pressure-receiving frame and a movable table to allow an operation surface to serve as a floating plate, thereby to correct any deflection produced in the pressure-receiving frame and the movable table.

13 Claims, 11 Drawing Figures

UNIFORM-PRESSURE PRESS APPARATUS

BACKGROUND OF THE INVENTION

The present invention relates to a uniform-pressure press apparatus, and more particularly, to a uniform-pressure press apparatus including a pressure equalizing chamber having a liquid enclosed therein which is independently provided in at least one of a pressure-receiving frame and a movable table, thereby to support the operation table in a floating plate-like state.

DESCRIPTION OF THE PRIOR ART

Examples of the conventionally known hydraulic presses include those shown in FIGS. 1 to 4, respectively. In the hydraulic press shown in FIG. 1, a pressure-receiving frame 1 is supported on a cylinder frame 2 through pillars 3, and a movable table 4 is vertically movably mounted on the pillars 3 as guides. The movable table 4 is secured to the upper surface of a ram 5, which is vertically movably housed in a pressure chamber 6 formed in the cylinder frame 2. It is to be noted that reference numerals 7 identify nuts, while numeral 8 identifies a packing gland. In addition, numerals 9, 10 respectively indicate operation surfaces, and numeral 11 identifies an oil-pressure inlet/outlet path. On the other hand, in the hydraulic press apparatus shown in FIG. 2, a piston 12 is employed in place of the ram 5. For vertically moving the piston 12, oil-pressure inlet/outlet paths 13, 14 are connected to pressure chambers 15, 16, respectively. Since the other parts are substantially the same as those shown in FIG. 1, the same parts in the Figure are denoted by the same reference numerals as those in FIG. 1 and a repeated description thereof is omitted. Moreover, in the hydraulic press apparatus shown in FIG. 3, in place of the ram 5 or the piston 12, a cylinder 17 is employed to support a movable table 18. In addition, a fixed ram 20 provided on a fixed frame 19 in place of the cylinder frame 2 is combined with a pressure chamber 21 formed in the cylinder 17. An oil-pressure inlet/outlet path 22 is connected to the pressure chamber 21. Since the other parts are the same as those shown in FIGS. 1 and 2, the same parts in the Figures are denoted by the same reference numerals and a repeated description thereof is omitted. In these conventional hydraulic press apparatuses, the press operation is conducted through the vertical movement of the movable table 4, 18 effected by feeding and discharging oil pressure into and from the pressure chamber 6, 15, 16, 21 and through both upper and lower dies 23, 24 mounted on the operation surface 9 on the pressure-receiving frame 1 side and the operation surface 10 on the movable table 4, 18 side, respectively. To permit a press operation with high accuracy, particularly a press operation in which the upper and lower dies 23, 24 must be accurately spotted, e.g., molding operation, it is necessary that when the load on both the upper and lower dies 23, 24 causes the upper die 23 to deflect following the deformation of the pressure-receiving frame 1 as shown in FIG. 4 (deflection is represented by $\delta$ in the figure), the movable table 4 should have a deflection similar to that of the upper die 23 to maintain both the operation surfaces 9, 10 in a parallel or dynamic parallel relation (it is to be noted that "dynamic parallel" in this case means that both the operation surfaces 9, 10 are parallel to each other under a dynamic state in operation). If this condition is not well satisfied, it will become impossible to bring the upper and lower dies 23, 24 into close contact with each other with a uniform pressure, resulting in a defective product unfavorably. The deflection $\delta$ is inevitably caused owing to the rigidity of the pressure-receiving frame 1 and the movable table 4, 18 as well as the method of transmitting forces, i.e., the intrinsic mechanism and design criterion of the appartus.

SUMMARY OF THE INVENTION

Accordingly, a primary object of the invention is to provide a uniform-pressure press apparatus capable of correcting the deflection of the movable table and easily obtaining a dynamic parallel relation between the operation surfaces of the pressure-receiving frame and the movable table, respectively, thereby to overcome the above-mentioned problems of the prior art.

To this end, according to the invention, there is provided a uniform-pressure press apparatus comprising: a pressure-receiving frame provided with an upper die; a movable table provided with a lower die; and a liquid-containing, pressure equalizing chamber formed in at least one of the pressure-receiving frame and the movable table, the pressure equalizing chamber having a size corresponding to that of an operation surface for mounting either of the upper and lower dies, so that the operation surface is supported through the pressure equalizing chamber.

The above and other objects, features and advantages of the invention will become clear from the following description of the preferred embodiments thereof taken in conjunction with the accompanying drawings.

DESCRIPTION OF THE PREFERRED EMBODIMENTS

Figure 1:
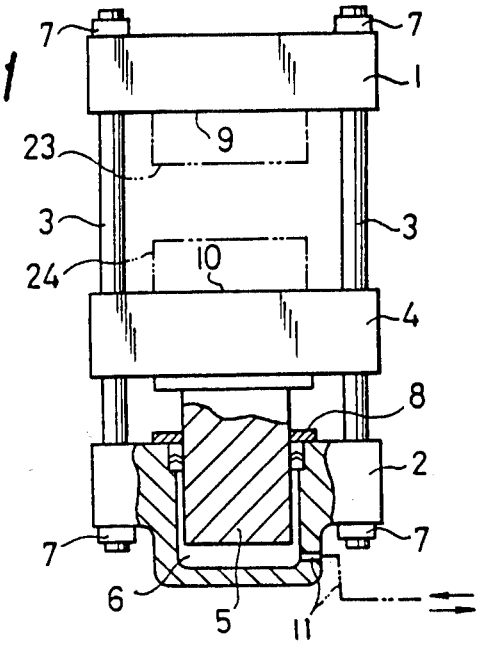
FIG. 1 PRIOR ART
FIGS. 1 to 3 are partly-sectioned side views of prior art embodiments of the hydraulic press apparatus as a uniform-pressure press apparatus, respectively.
Figure 2:
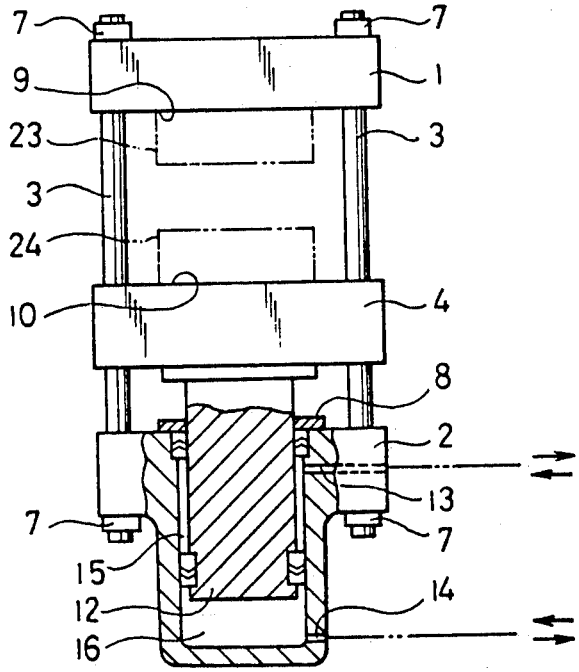
FIG. 2 PRIOR ART
Figure 3:
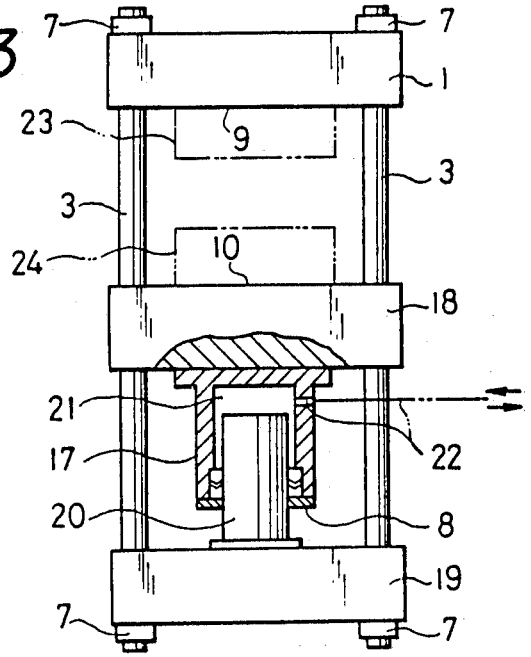
FIG. 3 PRIOR ART
Figure 4:
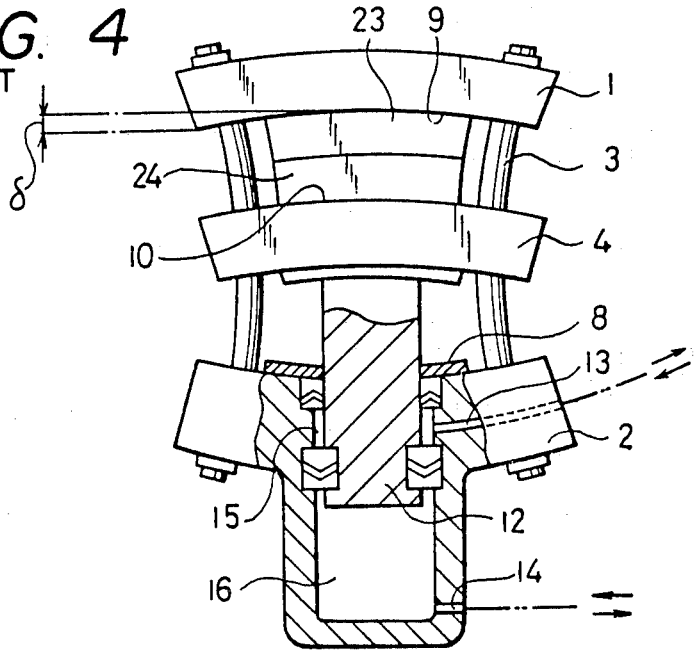
FIG. 4 PRIOR ART
FIG. 4 is a side view of the hydraulic press apparatus of FIG. 2 in the state where there is a deflection.

The invention will be described hereinunder with reference to the accompanying drawings. It is to be noted that the parts identical or similar to those in the prior art discussed above are represented by the same reference numerals hereinafter and a repeated description thereof is omitted.

Figure 5:
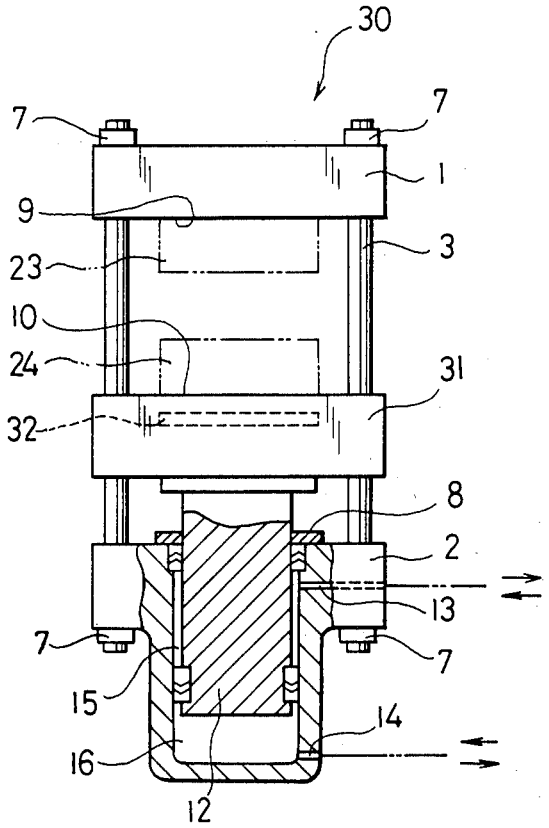
FIG. 5 is a side view of a hydraulic press apparatus corresponding to that shown in FIG. 2 as a uniform-pressure press apparatus in accordance with an embodiment of the invention.
Figure 6:
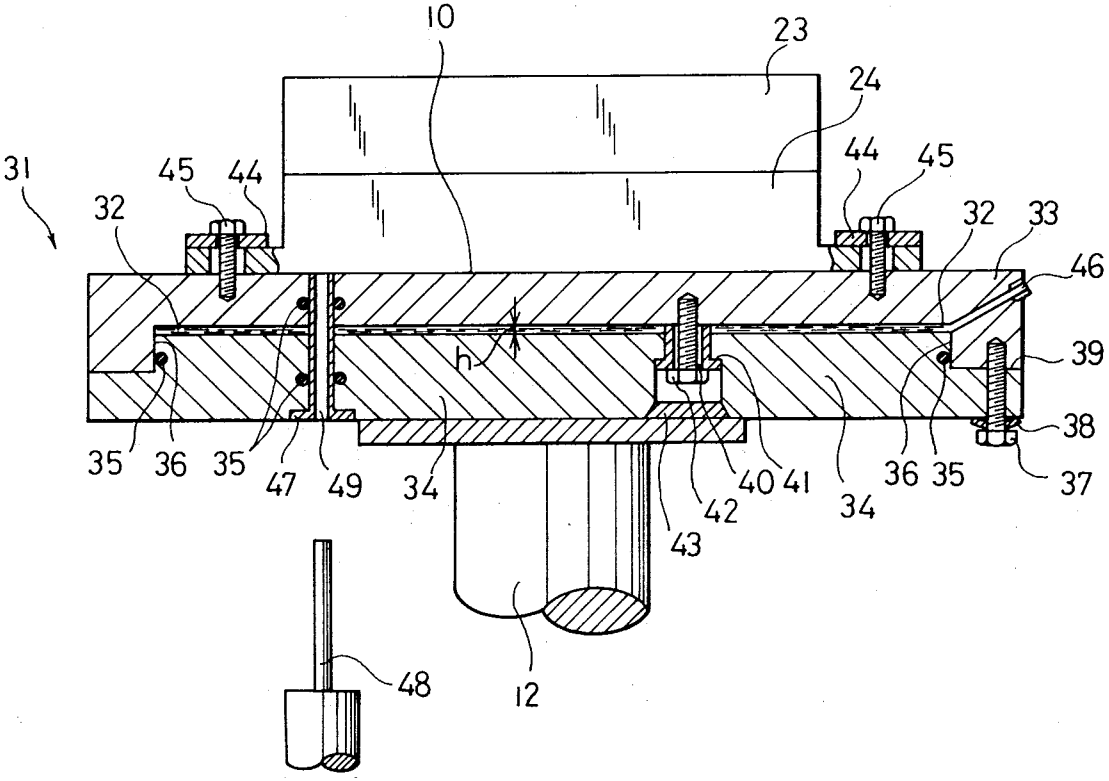
FIG. 6 is an enlarged sectional view of a movable table of the hydraulic press apparatus shown in FIG. 5.

FIGS. 5 and 6 in combination show an embodiment of the invention taking a hydraulic press apparatus as an example.

A hydraulic press apparatus 30 as a uniform-pressure press apparatus has a pressure equalizing chamber 32 formed in a movable table 31. More specifically, the movable table 31 is mainly divided into an operation table 33 and a movable table body 34, between which a liquid-containing, pressure equalizing chamber 32 is provided having a size corresponding to that of the operation surface 10. The presence of the pressure equalizing chamber 32 permits the operation table 33 to serve as a floating plate.

The pressure equalizing chamber 32 is a space, independent of the outside, that is provided between the operation table 33 and the movable table body 34 so as to have a size corresponding to that of the operation surface 10. The height h of the pressure equalizing chamber 32 is only required to be about several mm. As a liquid, an oil is enclosed in the pressure equalizing chamber 32 under zero pressure. When the hydraulic press apparatus 30 is used as a "heat press", a heat-resistant oil is employed as the oil to be enclosed, since the dies 23, 24 are heated up in operation.

The pressure equalizing chamber 32 is hermetically sealed and independent of the pressure chambers 15, 16 formed in the cylinder frame 2. Accordingly, even when the hydraulic press apparatus 30 is used as a "heat press", it is unnecessary to particularly cool the oil supplied to and discharged from the pressure chamber 15, since the pressure chamber 15 is independent of the pressure equalizing chamber 32 as well as separate from the lower die 24, which is heated up. It is to be noted that the height h of the pressure equalizing chamber 32 is properly determined according to the capacity of the press or the thickness of the operation table 33, and it is a matter of course that an oil which is pre-loaded by a proper pressure can be enclosed in the pressure equalizing chamber 32.

The movable table body 34 is for supporting the operation table 33 so that said table serves as a floating plate through the pressure equalizing chamber 32. The movable table itself is secured to the upper surface of a pressing/driving means (the piston 12 in the illustrated embodiment).

From the undersurface of the movable table body 34 to the operation table 33, a bolt 37 is screwed in combination with an initially conical disc spring 38 thereby to combine both the movable table body 34 and the operation table 33 as one unit. It is to be noted that, in FIG. 6, a parting line 39 shows the boundary between the operation table 33 and the movable table body 34, and both of them are reliably connected by means of the bolt 37 and the initially conical disc spring 38 regardless of whether the dimension h is small, as shown, somewhat larger. The dimension h can be larger than that illustrated in FIG. 6 and the conical disc spring 38 can be flattened to permit limited movement of operation table 33 away from table body 34 as needed. On the other hand, a bolt bore 40 is provided in the vicinity of the portion of the movable table body 34 where the piston 12 is attached. A ring 41 is fitted in the bolt bore 40, and a bolt 42 is screwed therein from the movable table body 34 to the operation table 33, thereby to transmit the parting force applied when the upper and lower dies 23, 24 are parted from each other as follows: the movable table body 34 transmits force to the bolt 42 which in turn transmits force to the operation table 33. It is to be noted that the bolt bore 40 is sealed with a plug 43.

On the upper surface of the operation table 33, i.e., the operation surface 10, the lower die 24 is secured by means of washers 44 and lower-die mounting bolts 45 in such a position as to be accurately spotted with the upper die 23 on the pressure-receiving frame 1. Moreover, the operation table 33 is provided with an oil inlet 46 for filling oil into the pressure equalizing chamber 32. It is to be noted that although the configuration of the operation table 33 can be selected at will, it is common to employ a square shape that is matched with the shape of the lower die 24. In addition, a through pipe 47 is fitted in both the movable table body 34 and the operation table 33, thereby to provide a through hole 49 for receiving an ejection rod 48.

It is to be noted that, in order to prevent the leakage of the oil enclosed in the pressure equalizing chamber 32, seal members 35 are disposed along a stepped mating portion 36 between the movable table body 34 and the operation table 33 as well as around the through pipe 47.

In operation, when a press operation is conducted through the upper and lower dies 23, 24 by vertically driving the movable table 31 by means of the oil pressure supplied from an oil-pressure source, not shown, the internal pressure applied to the lower die 24 from the pressing means through the movable table 31 becomes a reaction force when the lower die 24 has abutted on the upper die 23 to act on the lower die 24 as well as to automatically work on the operation table 33 vertically through the oil inside the pressure equalizing chamber 32. Thus, the operation table 33 is supported by the liquid pressure completely uniformly distributed inside the pressure equalizing chamber 32. It is to be noted that, when the liquid is cold, the compression amount of the liquid enclosed in the pressure equalizing chamber 32 is almost negligible since the height h of the pressure equalizing chamber 32 itself is small. Assuming now that the operation table 33 is serving as a floating plate and is a part of the lower die 24, the lower die 24 and the operation table 33 (floating plate) in combination constitute an elastic body under an equilibrium condition. The fact that this elastic body directly receives a completely uniformly distributed load through the liquid pressure means that it is possible to obtain the maximum uniform pressure state that can be attained.

Moreover, if the movable table body 34 tends to deflect, since the initially conical disc spring 38 is combined to the bolt 37, the operation table 33 can move at the parting line 39 independently of the movable table body 34 within the range allowed by the initially conical disc spring 38. Thus, while following the deflection of the die being deformed by pressing, the floating plate is deformed so as to continue to apply a uniform load to the die. The disc spring 38 also absorbs limited displacement of operation table 33 when the liquid is expanded.

Upon completion of pressing, the parting force applied to the movable table body 34 from the pressing means in order to part the lower die 24 from the upper die 23 is transmitted to the operation table 33 as well as the lower die 24 through the bolt 42. At this time, the disc spring 38 also exerts a force for withdrawing the table 33 and the movable table body 34 and the operation table 33 are in close contact with each other at the parting line 39 and both of them are withdrawn simultaneously.

It is to be noted that when the movable table 31 moves downwardly, the ejection rod 48 enters the lower die 24 through the through hole 49 to promote the removal of a product from the lower die 24.

Figure 7:
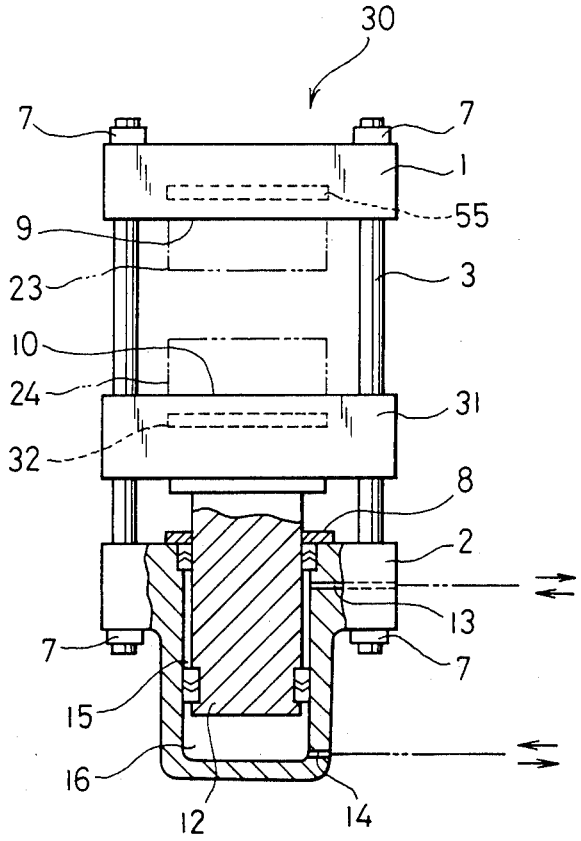
FIG. 7 is a side view of a hydraulic press apparatus corresponding to that shown in FIG. 5 as a uniform-pressure press apparatus in accordance with another embodiment of the invention.

FIG. 7 shows a second embodiment of the invention. In this embodiment, a pressure equalizing chamber 55 is independently formed inside the pressure-receiving frame 1 so as to have an area corresponding to that of the operation surface 9 and has a liquid enclosed therein to support the operation surface 9 in a floating plate-like state. Accordingly, when the pressure-receiving frame 1 is deflected, the liquid in the pressure equalizing chamber 55, e.g., an oil, provides a dynamic parallel relation between the operation surfaces 9, 10 similarly to the first-described embodiment.

Since the construction and operation of the other parts are similar to those in the first embodiment, the description thereof is omitted.

It is to be noted that either one of the pressure equalizing chamber 32 on the movable table 31 side and the pressure equalizing chamber 55 on the pressure-receiving frame 1 side may be employed, and both the pressure equalizing chambers 32, 55 may be employed at will.

Moreover, third and fourth embodiments of the invention will be described hereinunder with reference to FIGS. 8 to 11.

These embodiments are provided to improve the uniform-pressure press apparatus shown in the first and second embodiments. The intention thereof is to support one operation surface by a plurality of pressure equalizing chambers instead of supporting one operation surface by one pressure equalizing chamber, thereby to permit a more efficient correction of deflection, as well as to provide a uniform-pressure press apparatus which allows the pressure equalizing chambers to be easily machined.

It is to be noted that the parts identical or similar to those in the first and second embodiments are represented by the same reference numerals hereinafter and a repeated description and illustration thereof are omitted.

Figure 8:
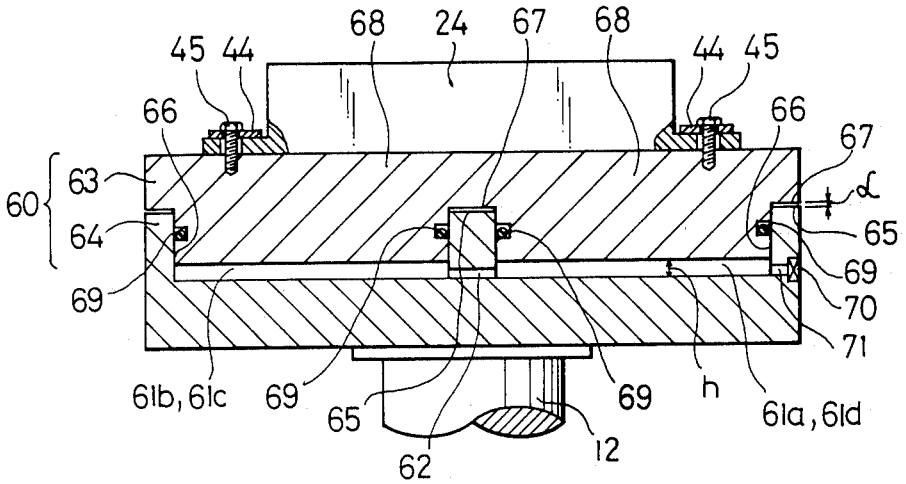
FIG. 8 is an enlarged sectional view of a hydraulic press apparatus corresponding to that shown in FIG. 6 as a uniform-pressure press apparatus in accordance with still another embodiment of the invention.
Figure 9:
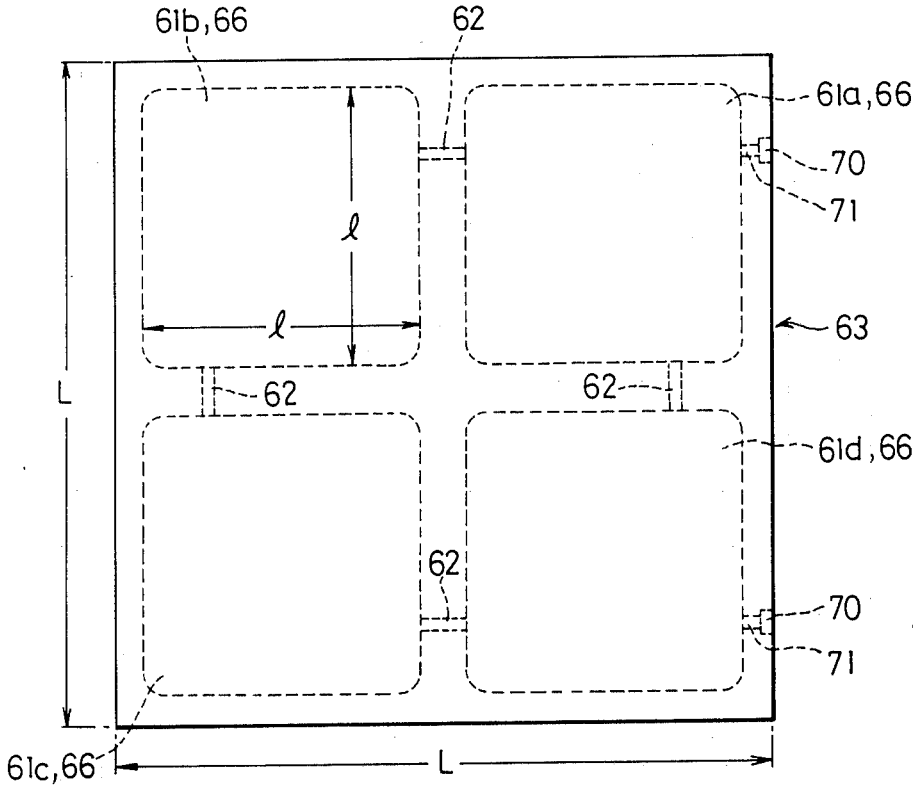
FIG. 9 is a plan viw of a movable table of the hydraulic press apparatus shown in FIG. 8.

FIGS. 8 and 9 in combination show a third embodiment of the invention. In the illustrated embodiment, "uniform-pressure press appartus" is shown as a hydraulic press apparatus 30. The hydraulic press apparatus 30 has a movable table 60, in which four pressure-equalizing chambers 61*a*, 61*b*, 61*c* and 61*d* are independently formed in the plane direction. The pressure equalizing chambers 61*a*, 61*b*, 61*c* and 61*d* are communicated with each other through a passage 62. In other words, an operation table 63 and a movable table body 64 in combination constituting the movable table 60 are divided similarly to those in the first and second embodiments, and "pressure equalizing chamber" is formed therebetween. In this embodiment, however, the operation table 63 is supported by a plurality of pressure equalizing chambers 61*a*, 61*b*, 61*c* and 61*d* so as to serve as a floating plate.

More specifically, on an upper surface portion 65 of the movable table body 64, four recesses 66 are formed in the plane direction so as to be equal in shape and size to each other. On the other hand, on a lower surface portion 67 of the operation table 63, four projections 68 of such a shape and size as to be able to fit into the recesses 66 are provided corresponding to the four recesses 66, respectively. Thus, as shown in FIG. 8, the recesses 66 and the projections 68 are combined to form the pressure equalizing chambers 61*a*, 61*b*, 61*c* and 61*d* inside the recesses 66, respectively. For this purposes, the operation table 63 and the movable table body 64 are combined together with a space of height h left inside each recess 66. As a result, the pressure equalizing chambers 61*a*, 61*b*, 61*c* and 61*d* with a height corresponding to the height h are formed inside the respective recesses 66, and the lower surface portion 67 of the operation table 63 is opposed to the upper surface portion 65 of the movable table body 64 through a gap with a dimension $\alpha$. In addition, the projections 68 are provided on their peripheries with O-rings 69, respectively, to seal the liquid enclosed in the pressure equalizing chambers 61*a*, 61*b*, 61*c* and 61*d*, respectively. Moreover, the passage 62 provides communication among the pressure equalizing chambers 61*a*, 61*b*, 61*c* and 61*d*, as shown in FIG. 9, so that the liquid enclosed in the pressure equalizing chambers 61*a*, 61*b*, 61*c* and 61*d* can circulate therethrough. Further, the pressure equalizing chambers 61*a* and 61*d* are connected to a liquid inlet 70 through another passage 71.

The following is the description of the operation of the uniform-pressure press apparatus shown in the third embodiment.

When a press operation is conducted through the upper and lower dies 23, 24 by driving the movable table 60 by means of the oil pressure supplied from an oil-pressure source, not shown, the pressure applied to the lower die 24 becomes a reaction force when the lower die 24 has abutted on the upper die 23 to act on the lower die 24 as well as to automatically work on the operation table 63 vertically through the liquid enclosed inside the four pressure-equalizing chambers 61*a*, 61*b*, 61*c* and 61*d*. This means that the operation table 63 is supported by the liquid pressure completely uniformly distributed inside the four pressure-equalizing chambers 61*a*, 61*b*, 61*c* and 61*d*.

Assuming now that the operation table 63 is serving as a floating plate and is a part of the lower die 24, the lower die 24 and the operation table 63 (floating table) in combination constitute an elastic body under an equilibrium condition. The fact that this elastic body directly receives a completely uniformly distributed load through the pressure of the liquid in the four pressure-equalizing chambers 61*a*, 61*b*, 61*c* and 61*d* means that it is possible to obtain the maximum uniform pressure state that can be attained.

Although the operation table 63 follows the deflection of the die being deformed by pressing, the deformation of the operation table 63 following the deflection of the die will continue to apply a uniform load to the lower die 24 while being regulated within the dimension $\alpha$ between the upper and lower surface portions 65, 67. It is to be noted that if the liquid enclosed in the pressure equalizing chambers 61*a*, 61*b*, 61*c* and 61*d* should leak, any excessive deformation of the operation table 63 will be prevented, since the lower surface portion 67 is supported by the upper surface portion 65 and this supporting state is obtained by the whole upper and lower surface portions 65, 67 as the mating surfaces of the operation table 63 and the movable table body 64, except for the projections 68 on the operation table 63 and the recesses 66 in the movable table body 64.

By the way, each of the four pressure-equalizing chambers 61*a*, 61*b*, 61*c* and 61*d* is formed so as to have a size corresponding to one of the portions obtained by equally dividing the plane size of the operation table 63 into quarters. Therefore, even when the width L of the operation table 63 is considerably large, the width l of each of the pressure equalizing chambers 61*a*, 61*b*, 61*c* and 61*d* is $L/2>l$. Accordingly, a machine tool having machining limits in length is only required to be able to effect machining to obtain not the width L but the width l; hence, the pressure equalizing chambers 61*a*, 61*b*, 61*c* and 61*d* are easy to machine. Conversely speaking, if the maximum machining length of a machine tool to be used is assumed to be l, the pressure equalizing chambers 61*a*, 61*b*, 61*c* and 61*d* can be easily machined for even a large-sized operation table 63 having a width up to 2l.

Since the construction and operation of the other parts are substantially similar to those in the first and second embodiments described with reference to FIGS. 5 to 7, a repeated description is omitted. It is to be noted that, in FIGS. 8 and 9, only the construction of the movable table 60 is shown and other parts are omitted, and also small parts in the movable table 60, e.g., the bolt 37, the initially conical disc spring 38 and so forth (see FIG. 6) are not shown.

Figure 10:
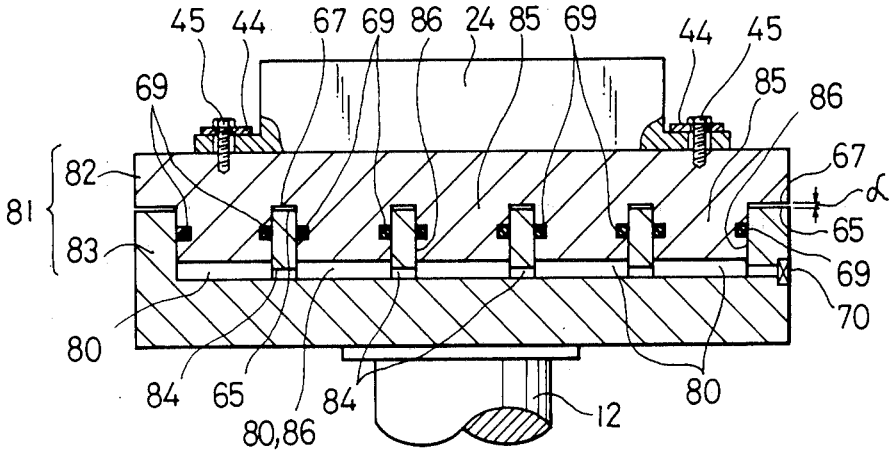
FIG. 10 is an enlarged sectional view of a hydraulic press apparatus corresponding to that shown in FIG. 8 as a uniform-pressure press apparatus in accordance with a further embodiment of the invention.
Figure 11:
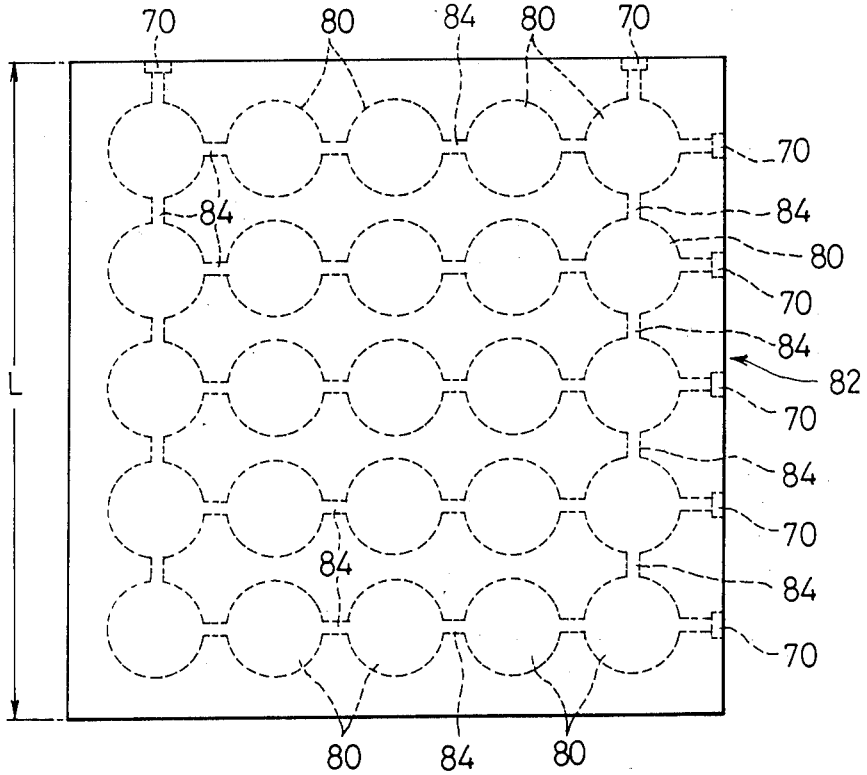
FIG. 11 is a plan view of a movable table of the hydraulic press apparatus shown in FIG. 10 corresponding to that shown in FIG. 9.

FIGS. 10 and 11 in combination show a fourth embodiment of the invention. Although in the third embodiment described with reference to FIGS. 8 and 9, "pressure equalizing chamber" has been shown as the four square pressure-equalizing chambers 61*a*, 61*b*, 61*c* and 61*d*, in this embodiment twenty-five pressure-equalizing chambers 80 are independently formed between an operation table 82 and a movable table body 83 in combination constituting a movable table 81. In addition, the pressure equalizing chambers 80 are communicated with each other through a passage 84.

According to this embodiment, the operation table 82 can be supported by a large number of pressure equalizing chambers 80 so as to serve as a floating plate. Therefore, it is possible to effect a highly efficient correction of deflection. In addition, projections 85 on the operation table 82 and recesses 86 in the movable table body 81 which in combination form the pressure equalizing chambers 80, respectively, can be easily formed by shaping small columns and boring small circular holes, respectively. It is to be noted that, particularly, the small circular holes can be well formed even by means of a small-sized machine tool.

Since the construction and operation of the other parts are substantially similar to those in the aforedescribed embodiments, the same parts in the Figures are denoted by the same reference numerals and a repeated description thereof is omitted.

Although in the third embodiment four square pressure-equalizing chambers 61*a*, 61*b*, 61*c* and 61*d* are formed in the movable table 60 and in the fourth embodiment twenty-five circular pressure equalizing chambers 80 are formed in the movable table 81, the shape, size, number and so forth of "pressure equalizing chamber" are not limited thereto. The conditions of the invention are satisfied, provided that a plurality of "pressure equalizing chambers" are independently formed in at least one of the pressure-receiving frame and the movable table in the plane direction and are communicated with each other through a passage.

As has been described, according to one aspect of the invention, the uniform-pressure press apparatus is constructed such that in at least one of the pressure-receiving frame provided with the upper die and the movable table provided with the lower die, the liquid-in-pressure equalizing chamber is formed having a size corresponding to that of the operation surface for mounting the die so as to support the operation surface through the pressure equalizing chamber. Therefore, the pressure equalizing chamber supports the operation surface in a floating plate-like state, so that the die and the operation surface supporting the same correct any deflection by means of a uniform pressure. Accordingly, both the pressure-receiving frame and the movable table can reliably obtain a dynamic parallel relation between their operation surfaces, so that the capacity of the press can be increased correspondingly. In addition, since the pressure equalizing chamber can be small in space and is completely independent of the outside, the liquid enclosed therein, e.g., an oil can be also extremely small in amount. Moreover, since the internal pressure of the enclosed liquid is automatically produced in response to the press driving pressure, there is no need for a special pressure source for the enclosed liquid, advantageously.

Moreover, according to the third and fourth embodiments, it is possible to except the following advantageous effects in addition to the above-mentioned various effects:

(A) Since a plurality of pressure equalizing chambers are formed, the objective portions (e.g., the operation table and the lower die mounted thereon) directly receive a completely uniformly distributed load, as an elastic body, through the pressure of the liquid enclosed in the pressure equalizing chambers, and this pressure equalizing action permits any deflection to be efficiently corrected.

(B) Since the plurality of pressure equalizing chambers are communicated with each other through a passage, the above-mentioned effect (A) can be satisfactorily expected, and in addition, it is easy to fill a liquid into all the pressure equalizing chambers.

(C) It is easy to effect machining by means of a machine tool, since small-sized pressure equalizing chambers are formed in a large-sized objective surface, e.g., the operation table. The larger the size of the objective surface, the more advantageous.

(D) Moreover, according to the embodiments, the range of the motion of the operation table to follow "deflection of the lower die" can be regulated within the dimension $\alpha$ between the lower surface portion of the operation table and the upper surface portion of the movable table body, and if the liquid enclosed in the pressure equalizing chambers should leak, it is possible to prevent any excessive deformation of the operation table (see FIGS. 9 and 10).

(E) The pressure equalizing chambers can be easily and satisfactorily machined by means of a small-sized machine tool, since the pressure equalizing chambers are formed by boring small circular holes (see FIGS. 10 and 11).

Although the invention has been described through specific terms, it is to be noted here that the described embodiments are not exclusive and various changes and modifications may be imparted thereto without departing from the scope of the invention which is limited solely by the appended claims.

What is claimed is:

1. A uniform-pressure press apparatus comprising:

a pressure-receiving frame provided with a first operation surface having an upper die mounted thereon;

a movable table provided with a second operation surface having a lower die mounted thereon;

a plurality of liquid-containing, pressure equalizing chambers independently formed in at least one of said pressure-receiving frame and said movable table and arranged in a planar array thereacross, said pressure equalizing chambers occupying an area corresponding to that of the operation surface for mounting either of said upper and lower dies, so that said operation surface is supported through said pressure equalizing chambers; and passage means for communicating said chambers with each other.

2. A uniform-pressure press apparatus according to claim 1, including a pressure chamber for moving said movable table with respect to said frame, and wherein said pressure equalizing chambers are independent of said pressure chamber for driving said movable table and said pressure equalizing chambers are hermetically sealed.

3. A uniform-pressure press apparatus according to claim 1, wherein said pressure equalizing chambers are independent hermetically sealed chambers having a small height and have an oil as a liquid enclosed therein.

4. A uniform-pressure press apparatus according to claim 1, wherein said movable table is comprised of an operation table for mounting said lower die and a movable table body for supporting said operation table, and wherein said pressure equalizing chambers are defined between said operation table and said movable table body, thereby allowing said movable table body to support said operation table in a floating plate-like state through said pressure equalizing chambers.

5. A uniform-pressure press apparatus according to claim 4, wherein said movable table body is provided with a through hole for receiving an ejection rod, said through hole extending through both said movable table body and said operation table and being sealed with respect to said pressure equalizing chambers.

6. A uniform-pressure press apparatus comprising:

a pressure-receiving frame having an upper die mounted thereon;

a movable table having a lower die mounted thereon;

at least one of said pressure-receiving frame and said movable table comprising (1) a body and (2) an operation table having an operation surface having a said die mounted thereon;

liquid-containing, pressure equalizing chamber means formed between said body and said operation table, said pressure equalizing chamber means having a size corresponding to that of the operation surface for mounting said die so that said operation table and said operation surface are supported through said pressure equalizing chamber means for movement with respect to said body; and a bolt and a spring coupled with said bolt for resiliently urging said bolt in one direction, said bolt being connected between said body and said operation table so that said body and said operation table are movable as a unit and said operation table is capable of limited movement with respect to said body against the urging of said spring.

7. A uniform-pressure press apparatus comprising:

a pressure-receiving frame provided with a first operation surface having an upper die mounted thereon;

a movable table comprising a table body and an operation table provided with a second operation surface having a lower die mounted thereon;

liquid-containing, pressure equalizing chamber means formed in said movable table, said pressure equalizing chamber means having a size corresponding to that of said second operation surface for mounting said lower die so that said operation table and said second operation surface are supported through said pressure equalizing chamber means for movement with respect to said table body; and a bolt and a conical disc spring coupled with said bolt for resiliently urging said bolt in one direction, said bolt being connected between said table body and said operation table so that said table body and said operation table are movable as a unit and said operation table is capable of limited movement with respect to said movable table body against the urging of said spring.

8. A uniform-pressure press apparatus according to claim 6 or claim 7, including a pressure chamber for moving said movable table with respect to said frame, and wherein said pressure equalizing chamber is independent of said pressure chamber for driving said movable table, and said pressure equalizing chamber means is hermetically sealed.

9. A uniform-pressure press apparatus according to claim 6 or claim 7 wherein said pressure equalizing chamber means comprises independent hermetically sealed chamber means having a small height and having an oil as a liquid enclosed therein.

10. A uniform-pressure press apparatus according to claim 6, wherein said movable table is comprised of an operation table for mounting said lower die and a movable table body for supporting said operation table, and wherein said pressure equalizing chamber means is defined between said operation table and said movable table body, thereby allowing said movable table body to support said operation table in a floating plate-like state through said pressure equalizing chamber means.

11. A uniform-pressure press apparatus according to claim 10, in which said bolt has a head disposed below said movable table body and said spring is an initially conical disc spring disposed between the underside of said movable table body and the head of said bolt for resiliently urging said bolt downwardly with respect to said movable table body, said bolt extending upwardly from below the underside of said movable table body through said table body and being attached to said operation table so as to connect said operation table and movable table body for movement as a unit and permitting limited upward movement of said operation table with respect to said movable table body against the urging of said disc spring.

12. A uniform-pressure press apparatus according to claim 10 or claim 11, wherein a driving means is attached to said movable table body for moving said movable table body upwardly and downwardly, and including a second bolt for transmitting to said operation table a parting force when said upper and lower dies are parted from each other, said second bolt being provided in the vicinity of the portion of said movable table body where said driving means is attached.

13. A uniform-pressure press apparatus according to claim 12, wherein said movable table body is provided with a through hole for receiving an ejection rod, said through hole extending through both said movable table body and said operation table and being sealed with respect to said pressure equalizing chambers.

* * * * *